United States Patent [19]

Barnes

[11] Patent Number: 5,037,288

[45] Date of Patent: Aug. 6, 1991

[54] PRESS FOR PRESSING MATERIALS SUCH AS FIBROUS MATERIALS INTO BOARD

[76] Inventor: Michael C. Barnes, 20 High Street, Beckingham, Doncaster, South Yorkshire DN10 4NW, England

[21] Appl. No.: 286,010

[22] Filed: Dec. 19, 1988

[30] Foreign Application Priority Data

Dec. 22, 1987 [GB] United Kingdom ..... 8729895

[51] Int. Cl.[5] ..... B30B 7/02

[52] U.S. Cl. ..... 425/338; 100/196; 100/199

[58] Field of Search ..... 100/193, 195, 196, 199; 156/583.1; 425/338, 406

[56] References Cited

U.S. PATENT DOCUMENTS

| | | | |
|---|---|---|---|
| 92,057 | 6/1869 | Judson et al. | 100/199 |
| 117,641 | 8/1871 | Judson | 100/199 |
| 709,285 | 9/1902 | Wilkes | 425/338 |
| 1,985,626 | 12/1934 | Taylor | 100/199 |
| 2,604,036 | 7/1952 | Miollis | 100/199 |
| 3,209,405 | 10/1965 | Loewenfeld | 100/199 |
| 3,251;472 | 5/1966 | Kurita | 100/195 |
| 3,624,778 | 11/1971 | Weber | 100/199 |
| 3,638,559 | 2/1972 | Parker | 100/199 |
| 3,810,730 | 5/1974 | Carlsson | 100/196 |
| 4,065,003 | 12/1977 | Hostettler | 100/196 |

*Primary Examiner*—Jay H. Woo
*Assistant Examiner*—C. Scott Bushey

[57] ABSTRACT

A press which includes first and second crossheads which can be moved toward and away from each other, a plurality of plates between the crossheads, and selective operable sets of stepped supports which are utilized with the plates to vary the distance between adjacent plates to accommodate different heights of material therebetween.

28 Claims, 5 Drawing Sheets

PRESS FOR PRESSING MATERIALS SUCH AS FIBROUS MATERIALS INTO BOARD

BACKGROUND OF THE INVENTION

This invention relates to a press for pressing materials such as fibrous materials into board.

Such presses, known as daylight platen presses, are used in the particle board industry and have been designed to produce boards of a particular thickness and as a result tend to be inflexible and uneconomic in producing boards of varying thicknesses. It is an object of the present invention to overcome this drawback.

SUMMARY OF THE INVENTION

According to the present invention a daylight platen press has means for changing the number of daylights in operation.

Preferably means are provided for locating the platens at predetermined vertical positions in the press and in one convenient construction where the platens in use are less than the maximum number utilizable, those not in operation are stacked in the press, e.g. at the top or bottom of the press.

The means for locating the platens conveniently comprises shoulder supports on to which the platens, or means connected thereto can be lowered. The shoulder supports may be provided on plates and in this case there may be two or more sets of such plates each of which has an appropriate number of supports according to the number of platens required to be in operation.

The press is preferably an hydraulic upstroking press having upper and lower fixed crossheads attached by four columns with prestressed tie rods.

In order to feed the press an infeed stacker is preferably provided which is adjustable so as to provide decks to correspond with the number of daylights in operation. The decks not required may be raised above the working area of the infeed stacker.

The decks are adapted to receive cauls and pushers are provided to push the cauls into the press An outfeed stacker may also be provided to receive the cauls from the press, and in this case is substantially similar to the infeed stacker.

Although the press may be used for various materials it is particularly suitable for pressing fibrous materials such as straw into boards, and the invention is also to be considered as including within its scope a press used exclusively for these materials, and also to boards produced from a press as set forth The invention may be performed in various ways and one specific embodiment will now be described by way of example with reference to the accompanying drawings in which:

DESCRIPTION OF THE PREFERRED EMBODIMENT

Figure 1:
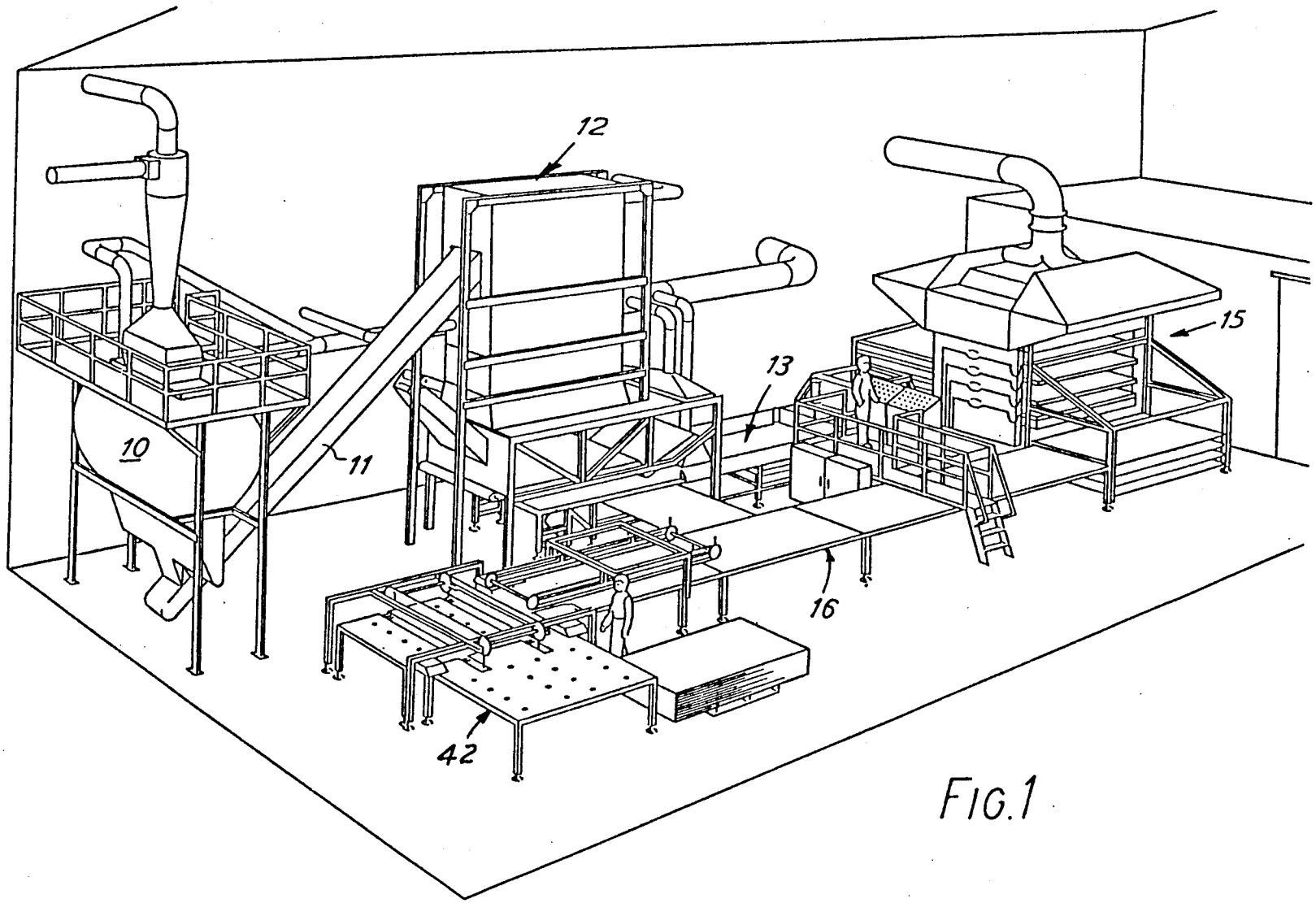
FIG. 1 - is a general view of apparatus of which the present invention forms a part FIG. 2 - is a schematic side elevation part of a press according to the present invention with four daylights in operation.
Figure 3:
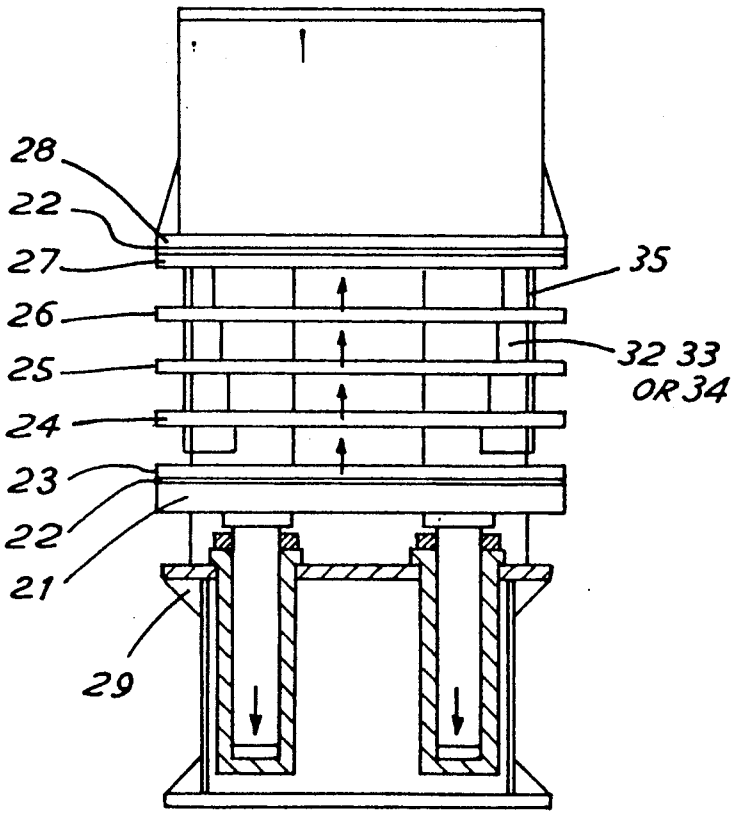
FIG. 3 - is an end view of the press of FIG. 2.
Figure 2:
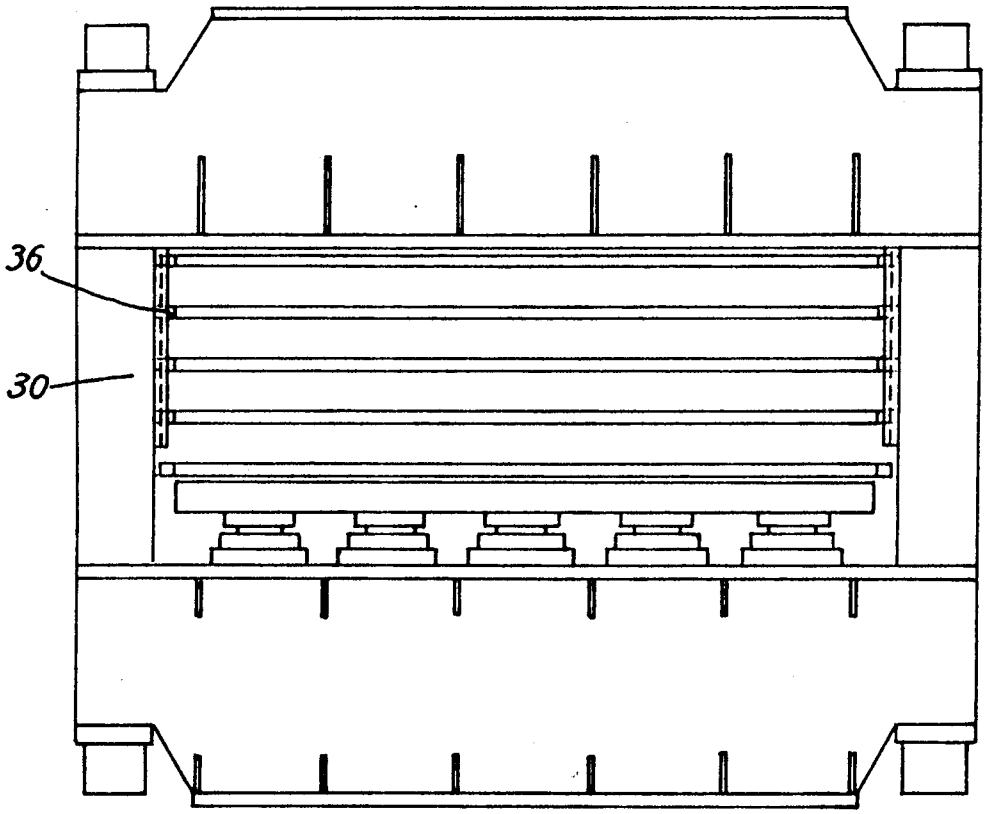
Figure 4A:
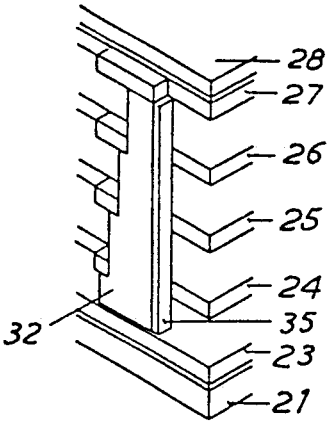
FIGS. 4A, 4B and 4C show one method of using the press respectively with four, three or two daylights in operation.
Figure 4B:
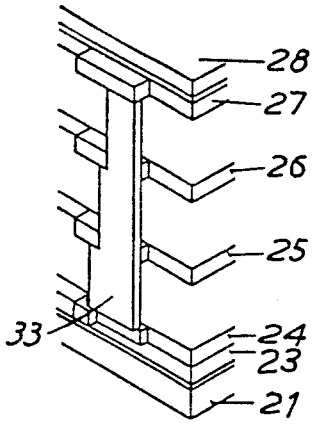
Figure 4C:
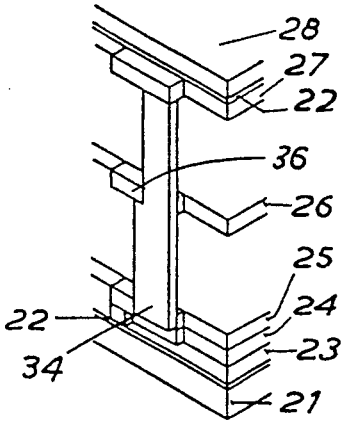

FIG. 1 shows a general layout of a machine for making boards from fibrous materials such as straw. In this Figure straw which has been slightly chopped is fed from a straw chopper into a hopper 10 in which resin is mixed into it. It then passes via an elevator 11 into a mattress (matt) laying unit 12. From the matt laying unit 12 straw matts are fed via cauls 13 which move matts to a press 15 which forms the subject of the present invention and which will be described in more detail below. After leaving the press the pressed matts are again taken by the cauls to a caul removal station 16 where they can be removed prior to being trimmed.

The press shown in FIG. 1 will now be described, in more detail with reference to FIGS. 2, 3, 4A, 4B, 4C, 5A, 5B and 5C. The press comprises a movable crosshead 21 having an insulation layer 22, steam heated platens 23, 24, 25, 26 and 27 and a fixed upper crosshead 28 and lower crosshead 29. The upper and lower fixed crossheads 28 and 29 are attached to each other by four columns 30 and each of these columns has provisions for bolting a christmas tree shaped plate thereto There are three sets of different christmas tree shaped plates, with four such plates in each set to provide support adjacent the four corners of the platens The sets are shown at 32, 33 and 34 in FIGS. 4A, 4B, 4C, respectively. Each such plate has a guide rail 35 bolted to it.

Close to each corner of the platens 24, 25 and 26 are four similar blocks 36 bolted to the platens The relative shape and position of the block 36 can be made to restrict the downward movement of the platen and restrict it at any vertical position required by contacting the christmas tree plate 32, 33 or 34.

The block 36, christmas tree 32, 33 or 34 and rail 35 also serve to restrain the platen in the longitudinal and lateral directions.

The christmas tree 32, 33 and 34 shown respectively in FIGS. 4A, 5A, 4B, 5B, and 4C, 5C, are arranged for four, three, and two daylight working. In the arrangement shown in FIGS. 4A, 4B, and 4C, unused platens are stacked on the movable crosshead 21 on top of platen 23 and in the arrangement shown in FIGS. 5A, 5B, and 5C they are supported on the christmas tree and supported below the upper fixed crosshead 28 directly below platen 27.

In either method for four daylight working, the christmas tree 32 supports three platens 24, 25 and 26. In the arrangement of FIG. 4 for three daylight working the christmas tree 33 supports two platens 25 and 26, while platen 24 rests on platen 23 and is carried by the movable crosshead 21. For two daylight working, the christmas tree 34 supports only platen 26 while platens 24 and 25 are carried by the movable crosshead.

Figure 5A:
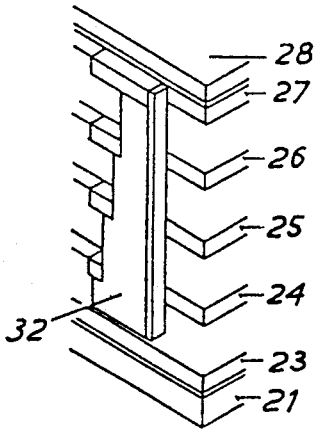
FIGS. 5A, 5B and 5C show another method of using the press respectively with four, three and two daylights in operation.
Figure 5B:
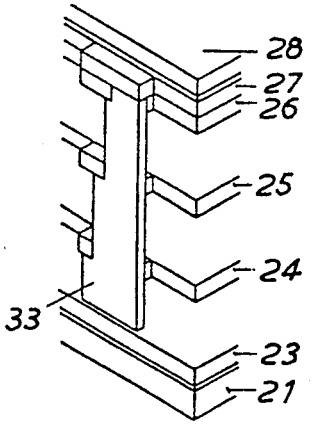
Figure 5C:
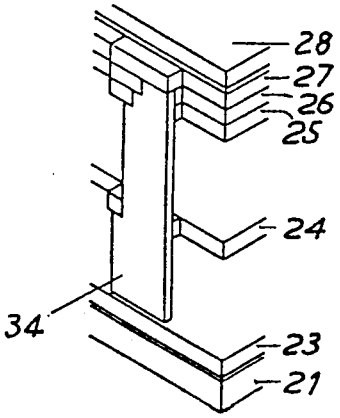

In the arrangement of FIG. 5B for three daylight working, the christmas tree 33 supports platens 24 and 25 and also supports platen 26 in a fixed position directly below platen 27. For two daylight working, christmas tree 34 supports platen 24 and also supports platens 25 and 26 in a fixed position directly below platen 27.

Figure 6:
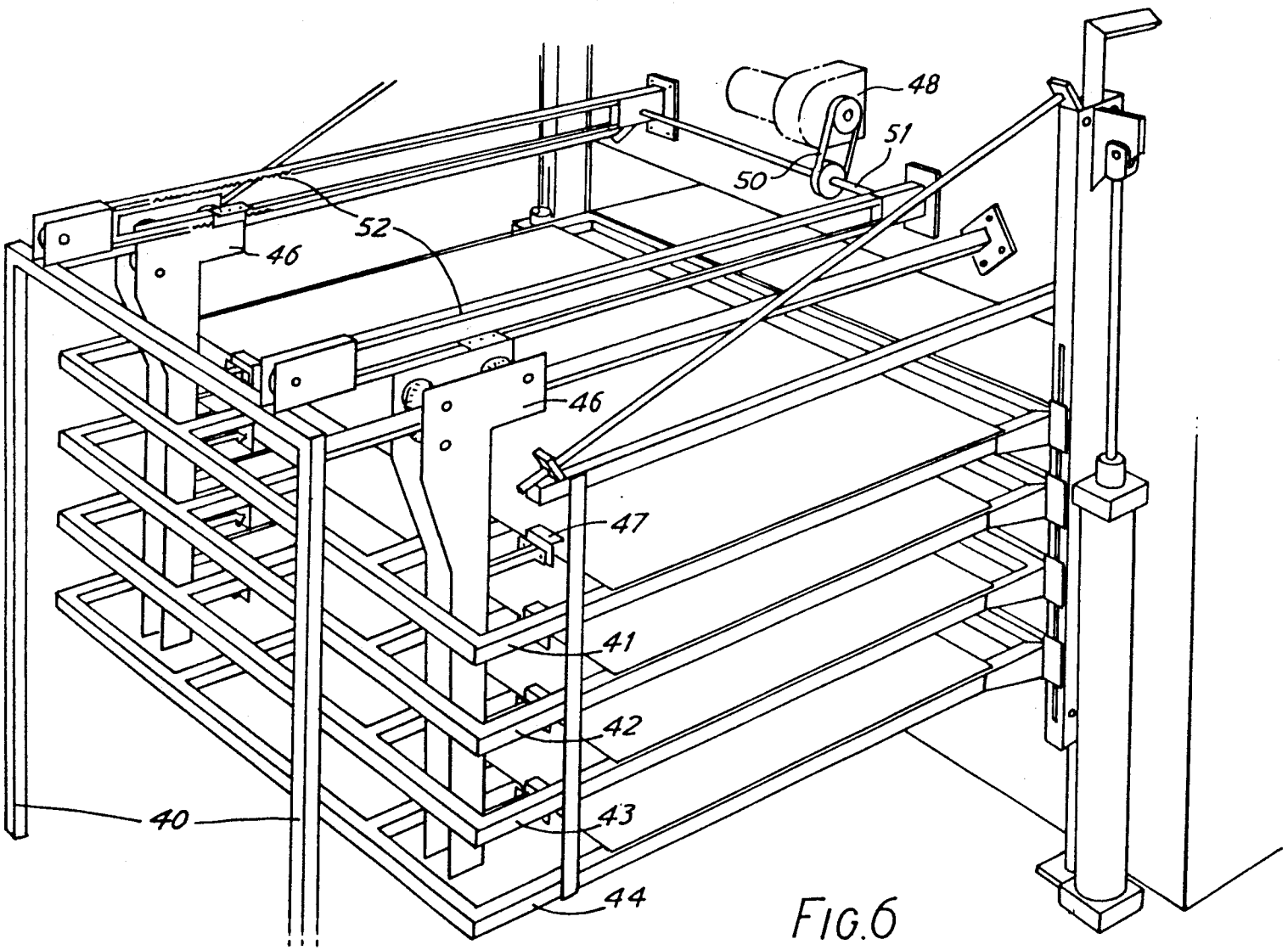
FIG. 6 - is a general view of an infeed stacker for four daylight operation, and FIG. 7 - is a general view of the infeed stacker for three daylight operation.
Figure 7:
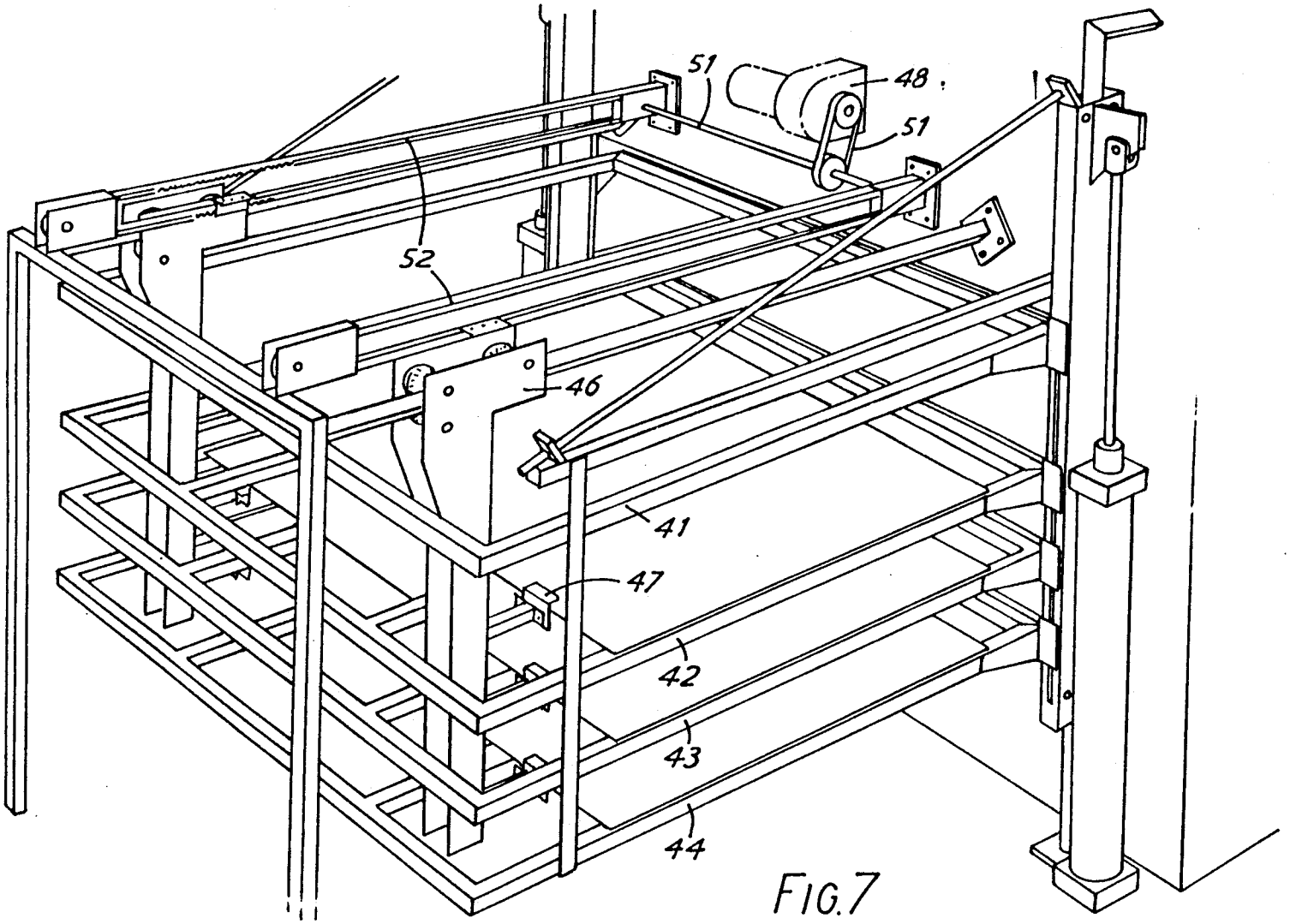

In order to feed the cauls into the platens at the appropriate level a press infeed stacker is provided as shown in FIGS. 6 and 7.

The stacker comprises a supporting frame indicated generally at 40. Cauls are received from the matt laying unit 12 and are received respectively onto decks shown in FIG. 6 at 41, 42, 43 and 44, the decks being adapted for a four daylight operation. In feeding the cauls onto the decks the first caul is received on deck 41 with the remaining decks stacked below it and after the caul is positioned on it is raised so as to allow the second deck 42 to move into position to receive the next caul. The decks are then raised hydraulically and are positioned to feed the cauls into the press. The cauls are then fed into the press by pushers 46 which have arms 47 which act directly on the cauls. The pushers are moved by a drive motor 48 acting via a chain 50 onto a thrust shaft 51 which in turn actuates further chains 52 to push the cauls into the press.

FIG. 7 shows the infeed press for use in a three daylight operation. In this case the unwanted deck 41 is raised above the working area and the heights of the removal decks 42, 43 and 44 adjusted to the positions required for three daylight operation. This may be effected either manually, hydraulically or electrically.

If only two daylight operation is required then decks 41 and 42 are raised above the working area.

Although not shown in detail an outfeed stacker is provided which is substantially similar to the infeed stacker but operating generally in reverse.

Although the daylight platen press has been described with particular reference to christmas tree plates these could be replaced by an hydraulic or an electrical operation.

I claim:

1. A press comprising a first crosshead and a second crosshead spaced a predetermined open distance from each other, a plurality of plates positioned between said crossheads, a selected first plurality of said plates being spaced a first predetermined maximum distance from each other, each two of said selected first plurality of plates defining a first space therebetween with each first space corresponding generally to said first predetermined maximum distance, each first space being sized to receive a first predetermined height of material therein, first interchangeable plate supporting means for supporting said first plurality of plates at said first predetermined maximum distance, a selected second plurality of said plates including at least one of said first plurality of plates being spaced a second predetermined distance from each other less than said first predetermined maximum distance, each two of said selected second plurality of plates defining a second space therebetween with each second space corresponding generally to said second predetermined distance, each second space being sized to receive a second predetermined height of material therein less than said first predetermined height, second interchangeable plate supporting means for supporting said second plurality of plates at said second predetermined distance, means for moving at least one of said crossheads to effect movement between said crossheads from said predetermined open distance to a lesser closed distance during which a selected one of said selected first plurality and second plurality of plates are moved relative to each other to reduce the respective first predetermined maximum distance and second predetermined distance therebetween whereby the material therebetween is compressed, and said first and second interchangeable plate supporting means being constructed and arranged to be selectively interchangeable and operative at different times in conjunction with said respective first plurality and second plurality of plates upon movement thereof by said moving means to at different times establish said first and second predetermined distances.

2. The press as defined in claim 1 wherein each of said first and second interchangeable plate supporting means include respective first and second means for locating said respective first and second plurality of plates at said respective first predetermined maximum distance and said second predetermined lesser distance.

3. The press as defined in claim 1 wherein at least one of said first plurality of plates is in abutting contact with an immediately adjacent one of said selected first plurality of plates.

4. The press as defined in claim 1 wherein at least one of said first plurality of plates is in abutting contact with an immediately adjacent one of said selected second plurality of plates.

5. The press as defined in claim 1 wherein at least one of said first plurality of plates is in abutting contact with an immediately adjacent underlying one of said selected first plurality of plates.

6. The press as defined in claim 1 wherein at least one of said first plurality of plates is in abutting contact with an immediately adjacent overlying one of said selected first plurality of plates.

7. The press as defined in claim 1 wherein at least one of said first plurality of plates is in abutting contact with an immediately adjacent underlying one of said selected second plurality of plates.

8. The press as defined in claim 1 wherein at least one of said first plurality of plates is in abutting contact with an immediately adjacent overlying one of said selected second plurality of plates.

9. The press as defined in claim 1 wherein said first and second interchangeable plate supporting means support the respective first and second plurality of plates in generally parallel relationship to each other and generally parallel to a horizontal plane.

10. The press as defined in claim 1 wherein each of said first and second interchangeable plate supporting means include respective first and second means for locating said respective first and second plurality of plates at said respective first predetermined maximum distance and said second predetermined lesser distance, and said first and second locating means locate said respective first and second plurality of plates in generally parallel relationship to each other and generally parallel to a horizontal plane.

11. The press as defined in claim 10 wherein said first and second locating means each include a plurality of abutment surface means for each abuttingly contacting one plate of said respective selected first and second plurality of plates, the distance between adjacent abutment surface means of said first locating means corresponding generally to said first predetermined maximum distance, and the distance between adjacent abutment surface means of said second location means corresponding generally to said second predetermined lesser distance.

12. The press as defined in claim 10 wherein said first and second locating means each include a plurality of abutment surface shoulder means for each abuttingly contacting one plate of said respective selected first and second plurality of plates, the distance between adjacent abutment surface shoulder means of said first locating means corresponding generally to said first predetermined maximum distance, and the distance between adjacent abutment surface should means of said second locating means corresponding generally to said second predetermined lesser distance.

13. The press as defined in claim 10 wherein said first and second locating means each include a plurality of abutment surface shoulder means for each abuttingly contacting one plate of said respective selected first and second plurality of plates, the distance between adjacent abutment surface shoulder means of said fist locating means corresponding generally to said first predetermined maximum distance, the distance between adjacent abutment surface shoulder means of said second locating means corresponding generally to said second predetermined lesser distance, and each said abutment surface shoulder means is a stepped shoulder.

14. The press as defined in claim 10 wherein said first and second locating means each include a plurality of abutment surface shoulder means for each abuttingly contacting one plate of said respective selected first and second plurality of plates, the distance between adjacent abutment surface shoulder means of said first locating means corresponding generally to said first predetermined maximum distance, the distance between adjacent abutment surface shoulder means of said second locating means corresponding generally to said second predetermined less distance, each said abutment surface shoulder means is a stepped shoulder, and said abutment surface shoulder means is defined by at least one plate associated with each of said first and second plurality of plates.

15. The press as defined in claim 1 including means for feeding a first plurality of materials each of first predetermined height each into one of said first spaces and for feeding a second plurality of materials each of a second predetermined height less than said first predetermined height each into one of said second spaces, and said feeding means being constructed and arranged to be selectively operative individually with said respective first plurality and second plurality of plates.

16. The press as defined in claim 1 including means for feeding a first plurality of materials each of first predetermined height each into one of said first spaces and for feeding a second plurality of materials each of a second predetermined height less than said first predetermined height each into one of said second spaces, said feeding means being constructed and arranged to be selectively operative individually with said respective first plurality and second plurality of plates, said materials feeding means include a first and second plurality of decks upon which is deposited said first and second pluralities of materials respectively.

17. The press as defined in claim 2 wherein at least one of said first plurality of plates is in abutting contact with an immediately adjacent one of said selected first plurality of plates.

18. The press as defined in claim 2 wherein at least one of said first plurality of plates is in abutting contact with an immediately adjacent one of said selected second plurality of plates.

19. The press as defined in claim 2 wherein at least one of said first plurality of plates is in abutting contact with an immediately adjacent underlying one of said selected first plurality of plates.

20. The press as defined in claim 2 wherein at least one of said first plurality of plates is in abutting contact with an immediately adjacent overlying one of said selected first plurality of plates.

21. The press as defined in claim 2 wherein at least one of said first plurality of plates is in abutting contact with an immediately adjacent underlying one of said selected second plurality of plates.

22. The press as defined in claim 2 wherein at least one of said first plurality of plates is in abutting contact with an immediately adjacent overlying one of said selected second plurality of plates.

23. The press as defined in claim 11 wherein at least one of said first plurality of plates is in abutting contact with an immediately adjacent one of said selected first plurality of plates.

24. The press as defined in claim 11 wherein at least one of said first plurality of plates is in abutting contact with an immediately adjacent one of said selected second plurality of plates.

25. The press as defined in claim 11 wherein at least one of said first plurality of plates is in abutting contact with an immediately adjacent underlying one of said selected first plurality of plates.

26. The press as defined in claim 11 wherein at least one of said first plurality of plates is in abutting contact with an immediately adjacent overlying one of said selected first plurality of plates.

27. The press as defined in claim 11 wherein at least one of said first plurality of plates is in abutting contact with an immediately adjacent underlying one of said selected second plurality of plates.

28. The press as defined in claim 11 wherein at least one of said first plurality of plates is in abutting contact with an immediately adjacent overlying one of said selected second plurality of plates.

* * * * *